US005232004A

United States Patent [19]

Wu

[11] Patent Number: 5,232,004

[45] Date of Patent: Aug. 3, 1993

[54] AUTOMATIC UMBRELLA HAVING WIND-RESISTANT BUFFER EFFECT

[76] Inventor: Woh-Wen Wu, P.O. Box 55-1670, Taipei, Taiwan

[21] Appl. No.: 947,913

[22] Filed: Sep. 21, 1992

[51] Int. Cl.[5] ..... A45B 25/14

[52] U.S. Cl. ..... 135/24; 135/25.33; 135/25.41; 135/28; 135/38

[58] Field of Search ..... 135/22-24, 135/25.1, 25.4, 25.41, 28, 37-40, 44, 25.35

[56] References Cited

U.S. PATENT DOCUMENTS

| | | | |
|---|---|---|---|
| 3,074,419 | 1/1963 | Foltis et al. | 135/22 |
| 3,625,236 | 12/1971 | Hayano | 135/22 |
| 3,729,012 | 4/1973 | Weber | 135/22 X |
| 3,746,025 | 7/1973 | Murata | 135/22 |
| 3,828,805 | 8/1974 | Thur | 135/22 |
| 4,548,222 | 10/1985 | Day | 135/24 |
| 4,860,776 | 8/1989 | McQuain | 135/24 X |
| 4,989.625 | 2/1991 | Wu | 135/24 X |
| 5,125,426 | 6/1992 | Wu et al. | 135/44 X |
| 5,144,969 | 9/1992 | Chou et al. | 135/22 |

FOREIGN PATENT DOCUMENTS 0291589 11/1988 World Int. Prop. O. ..... 135/24

*Primary Examiner*—Richard E. Chilcot, Jr.
*Assistant Examiner*—Lan M. Mai

[57] ABSTRACT

An automatic umbrella includes: a central shaft, a plurality of ribs secured with an umbrella cloth and pivotally secured to the central shaft, an umbrella-opening spring, an umbrella-closing spring, and a control device having a resilient retainer slidably held within an elongate slot formed in the central shaft, whereby upon an acting of a wind pressure on the umbrella cloth to lower the umbrella ribs and the resilient retainer, the elongate slot formed in the central shaft provides a buffer for allowing a downward movement of the resilient retainer and a folding of the umbrella ribs to temporarily reduce a wind-catching area of the umbrella cloth to decrease a total wind force acting on the umbrella for a lighter holding of the umbrella especially under a strong wind.

8 Claims, 5 Drawing Sheets

AUTOMATIC UMBRELLA HAVING WIND-RESISTANT BUFFER EFFECT

BACKGROUND OF THE INVENTION

A conventional umbrella when subjected to a wind pressure will be difficulty carried by a user when opening the umbrella. If the wind pressure is Pw and an area of the opened umbrella cloth is A, a total wind force acting upon the umbrella which is held by the umbrella user will be $Pw \times A = Wc$. If a lower runner pivotally secured with the umbrella ribs is disengaged and lowered from the central shaft of the umbrella trying to fold the umbrella cloth and to reduce its total area subjected to the wind pressure, the user should still firmly grasp the lower runner to overcome a strong wind force acting upon the umbrella cloth, the ribs and the lower runner, easily causing fatigue and inconvenience to the umbrella user.

SUMMARY OF THE INVENTION

The object of the present invention is to provide an automatic umbrella including: a central shaft, a plurality of ribs secured with an umbrella cloth and pivotally secured to the central shaft, an umbrella-opening spring, an umbrella-closing spring, and a control device having a resilient retainer slidably held within an elongate slot formed in the central shaft, whereby upon an acting of a wind pressure on the umbrellâ cloth to lower the umbrella ribs and the resilient retainer, the elongate slot formed in the central shaft provides a buffer for allowing a downward movement of the resilient retainer and a folding of the umbrella ribs to temporarily reduce a wind-catching area of the umbrella cloth to decrease a total wind force acting on the umbrella for a lighter holding of the umbrella especially under a strong wind.

DETAILED DESCRIPTION

Figure 1:
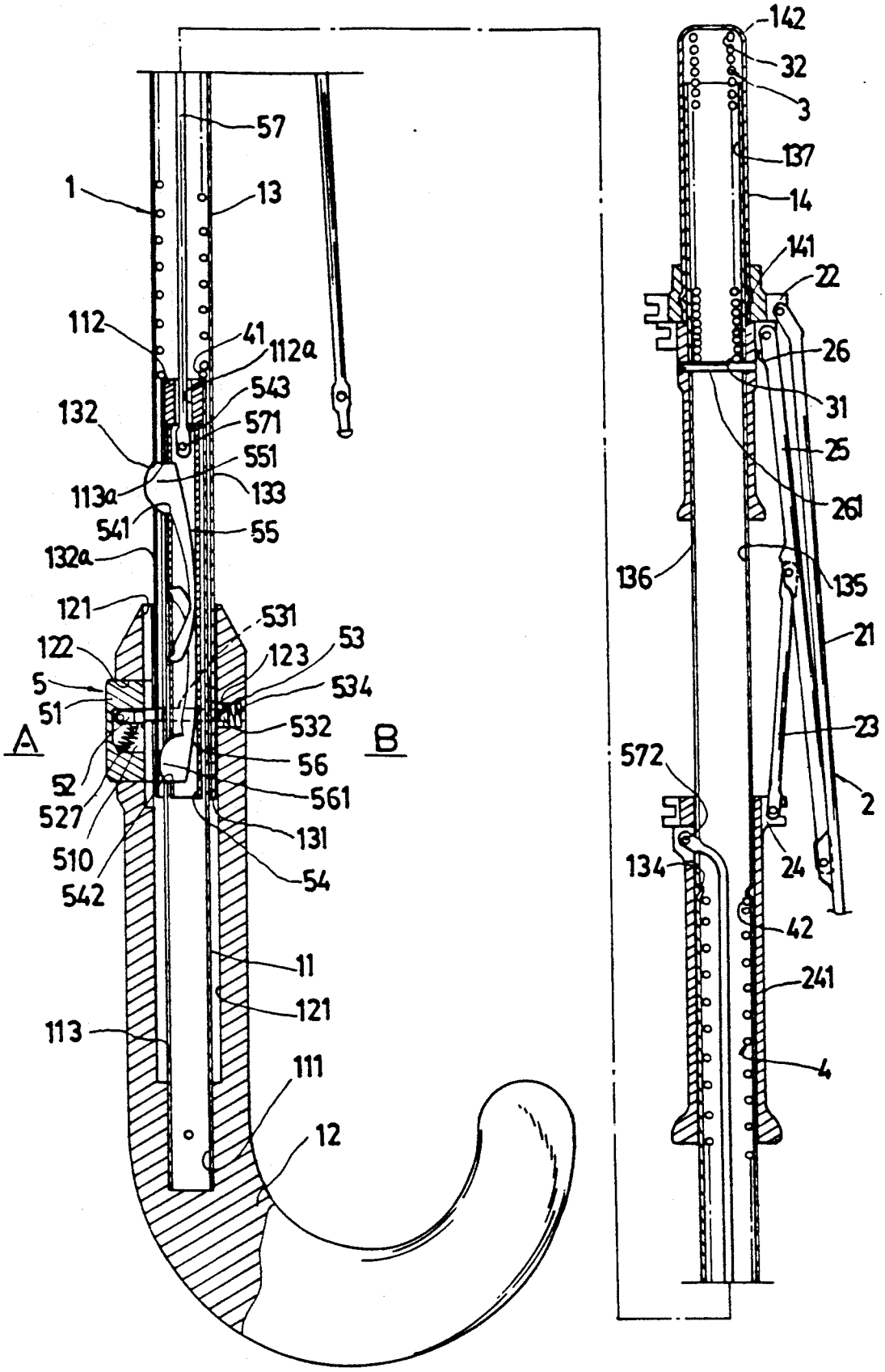
FIG. 1 shows a folded umbrella of the present invention in which the umbrella-closing spring is not yet compressed for storing its elastic energy.

As shown in the drawing figures, the present invention comprises: a central shaft means 1, an umbrella rib means 2, an umbrella-opening spring 3, an umbrella-closing spring 4, and a control means 5.

The umbrella rib means 2 may be as shown in the figures, or may be modified to be other ribs structure without limiting the number, shapes and structures of the ribs.

The central shaft means 1 includes: an inner tube 11 having a grip 12 secured on a lower portion of the inner tube 11, a main tube 13 slidably disposed around the inner tube 11, and a top sleeve 14 slidably held on an upper end portion 137 of the main tube 13.

The umbrella rib means 2 secured with an umbrella cloth (not shown) thereon includes: a top rib 21 having its inner rib end pivotally secured with an upper notch 22 secured on a lower portion 141 of the top sleeve 14, a stretcher rib 23 having an inner rib end of the stretcher rib 23 pivotally secured to a lower runner 24 which is slidably held on the main tube 13, an intermediate rib 25 pivotally secured to a middle notch 26 which is secured on an upper end portion of the main tube 13 by a pin 261 adjacent to a lower end portion of the top sleeve 14 with a middle rib portion of the intermediate rib 25 pivotally secured to an outer rib end of the stretcher rib 23.

The umbrella-opening spring 3, resiliently retained between the top sleeve 14 and the upper end portion of the main tube 13, has a lower spring end 31 retained inside an upper end portion of the main tube 13 or retained on the pin 261 of the middle notch 26, and an upper spring end 32 retained in a cap 142 of the top sleeve 14 to allow the top sleeve 14 resiliently jacketed on the upper end portion 137 of the main tube 13.

The umbrella-closing spring 4 resiliently retained between the inner tube 11 and the main tube 13, has a lower spring end 41 retained on an upper end portion 112 of the inner tube 11, and an upper spring end 42 retained on an inner extension ring 134 positioned in an intermediate portion of the main tube 13.

The control means 5 includes: a push button 51 slidably held in a button hole 122 formed in the grip 12 at a first side A of the shaft means 1, a biasing plate 52 pivotally mounted in the push button 51, a sliding latch 53 laterally slidably held in the grip 12 adjacent to a second side B of the shaft means opposite to the first side A of the shaft means 1 for operatively engaging the main tube 13 for retaining the umbrella-closing spring 4 which has been compressed for storing an elastic energy of the umbrella-closing spring 4, a core tube 54 slidably held in the inner tube 11 having an upper resilient engaging retainer 55 formed in an upper portion of the core tube 54 for operatively engaging the main tube 13 at a closing state of the umbrella and having a lower resilient engaging retainer 56 formed in a lower portion of the core tube 54 for operatively engaging the main tube 13 at an opening state of the umbrella, and a drag rod 57 connected between the core tube 54 and the lower runner 24, whereby upon a depression of the push button 51 when the umbrella is closed or folded to disengage the upper resilient engaging retainer 55 from the main tube 13, the umbrella-opening spring 3 will urge the rib means and the umbrella cloth for opening the umbrella; and upon a depression of the push button 51 when the umbrella is opened to disengage the main tube 13 from the inner tube 11, the umbrella-closing spring will eject the main tube for folding the rib means for closing the umbrella.

Figure 6:
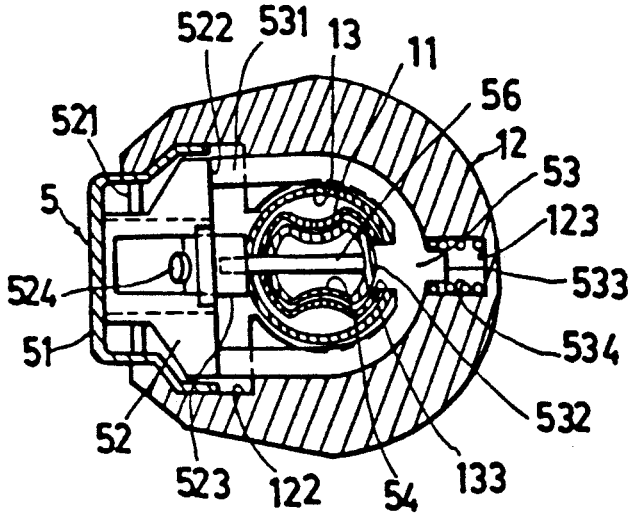
FIG. 6 is a cross sectional drawing of the present invention when viewed from 6—6 direction of FIG. 3.

The core tube 54 slidably engageable with the inner tube 11 may be made to have a cross section of a tenon and mortise-like engagement for their aligned reciprocative movement as shown in FIG. 6 without being twisted or rotated in operating the umbrella.

Figure 2:
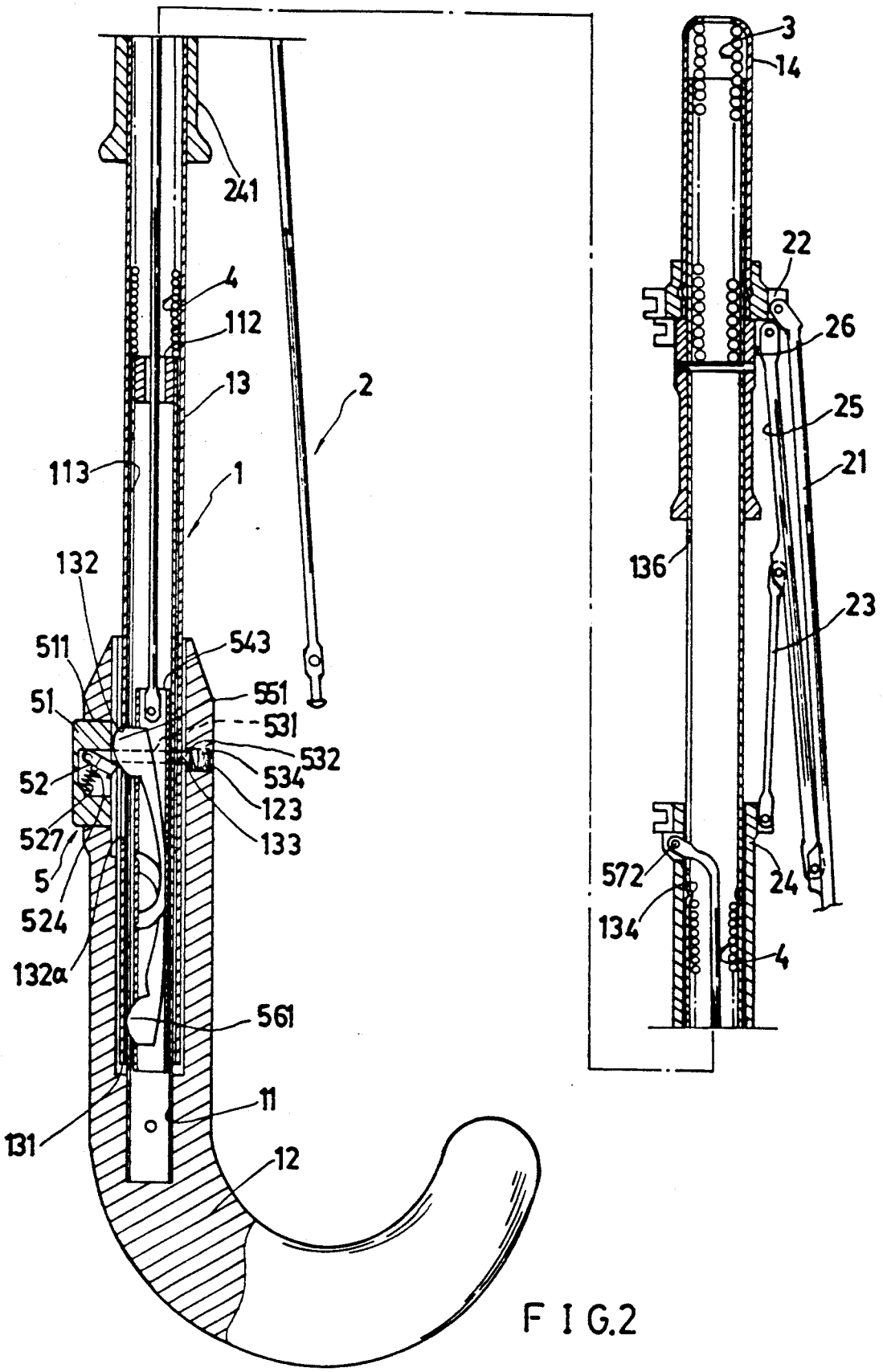
FIG. 2 shows the umbrella being compressed for storing the elastic energy of the umbrella-closing spring from FIG. 1.

The grip 12 is formed with a central longitudinal hole 121 for slidably inserting a lower portion 131 of the main tube 13 into the hole 121 to be slidably disposed about a lower portion 111 of the inner tube 11 as shown in FIGS. 1, 2.

The umbrella-opening spring 3, once being released its elastic energy when opening the umbrella, will be reset for storing its elastic energy during the umbrella closing process as being compressed by the umbrella-closing spring 4 which releases its spring energy when closing the umbrella.

The push button 51 includes: an upper button surface 511 formed on an upper inside portion of the button 51 operatively contacting an upper protrusion 551 of the upper engaging retainer 55, a lower button surface 512 formed on a lower inside portion of the button 51 operatively contacting a lower protrusion 561 of the lower engaging retainer 56, an inner cavity 510 recessed in an inner portion of the button 51 between the upper and lower button surfaces 511, 512 for pivotally mounting the biasing plate 52 in the cavity 510, a pair of brackets 513 for pivotally engaging two pivots 521 of the biasing plate 52, and an inclined-surface portion 512*a* formed in a lower portion of the cavity 510 for retaining a restoring spring 527 for normally urging the biasing plate 52 to be horizontally positioned.

Figure 3:
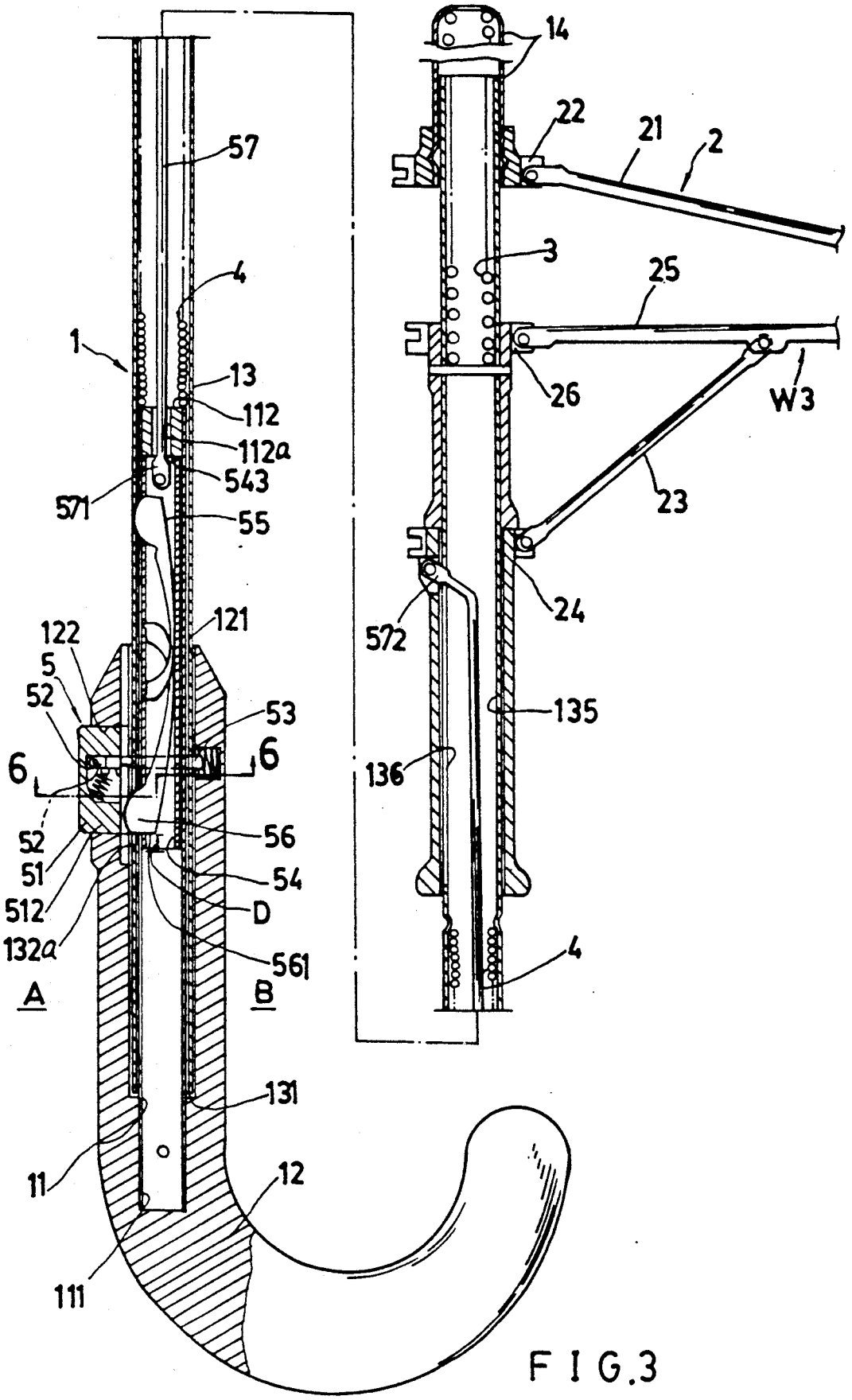
FIG. 3 shows an opened umbrella from FIG. 2.

The biasing plate 52 is generally triangular shaped and enlarged inwardly towards a center of the central shaft means 1 to form two depression surfaces 522 contacting two bifurcate arm members 531 of the sliding latch 53 as shown in FIG. 6, and includes: a sliding plate 523 slidably held in a groove 525 recessed in the biasing plate 52 and retained by a limiting bracket 526 formed under the biasing plate 52, a stem 524 protruding inclinedly downwardly from the sliding plate 523 for retaining the restoring spring 527 retained in the push button 51, and the restoring spring 527 normally urging the sliding plate 526 horizontally for contacting the two bifurcate arm members 531 of the sliding latch 53, and urging the sliding plate 526 inwardly to be protruded beyond the depression surfaces 522 of the biasing plate 52 to be operatively pressed or bent downwardly by the upper retainer 55 when compressing the spring 4 from FIG. 1 to FIG. 2 for preventing an unexpected false depression of the sliding latch 53 for disengaging the main tube 13 from the inner tube 11 for falsely releasing the elastic energy of the umbrella-closing spring 4 when opening the umbrella from FIG. 2 to FIG. 3.

The sliding latch 53 includes: the two bifurcate arm members 531 laterally slidably disposed about the main tube 13 as shown in FIG. 6, a latch rod 533 formed on a converging end of the two arm members 531 jacketed by a tensioning spring 534 retained in a spring hole 123 formed in a second side B of the shaft means 1 for normally urging the two bifurcate arm members 531 laterally to be contacted by the biasing plate 52, a wedge portion 532 secured on the latch rod 533 between the two arm members 531 for engaging an engaging hole 133 formed in the main tube 13 at the second side B of the shaft means 1 for coupling the main tube 13 with the inner tube 11 having the umbrella-closing spring 4 under compression retained in between the main and the inner tubes 13, 11.

The core tube 54 slidably held in the inner tube 11 includes the upper retainer 55 having the upper protrusion 551 and the lower retainer 56 having the lower protrusion 561 slidably engageable with an elongate slot 113 formed in the inner tube 11 at the first side A of the shaft means 1 having a lower slot end of the elongate slot 113 approximating a lower end portion of the inner tube 11 and having an upper slot end 113*a* of the elongate slot 113 adjacent to an upper end portion 543 of the core tube 54, with the upper protrusion 551 operatively engaging a protrusion engaging hole 132 formed in the main tube 13 at the first side A of the shaft means 1 for closing the umbrella (FIG. 1) and with the lower protrusion 561 operatively engaging the protrusion hole 132 in the main tube 13 for opening the umbrella (FIG. 3).

Figure 4:
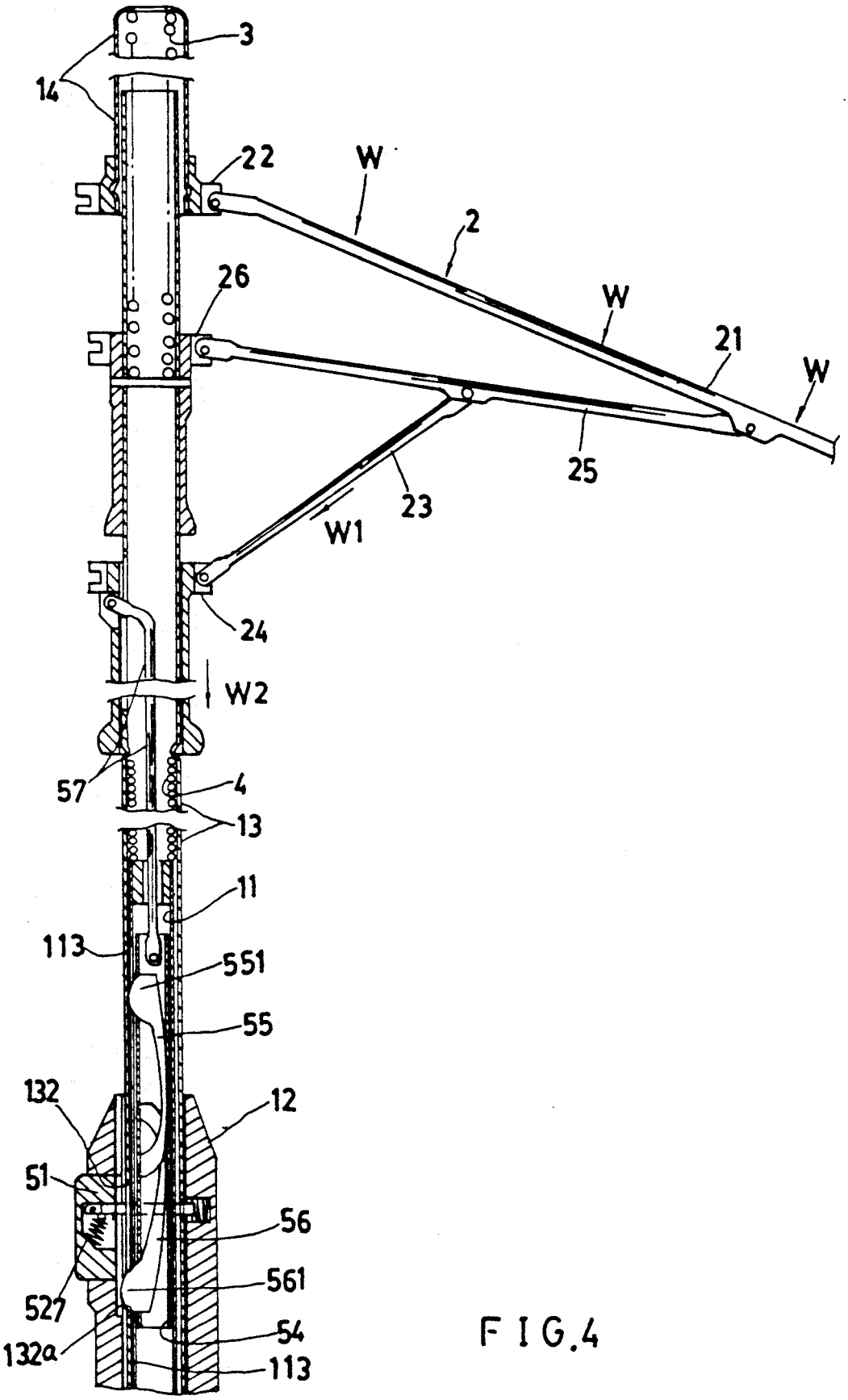
FIG. 4 is an illustration of the present invention when subjected to wind pressure.
Figure 5:
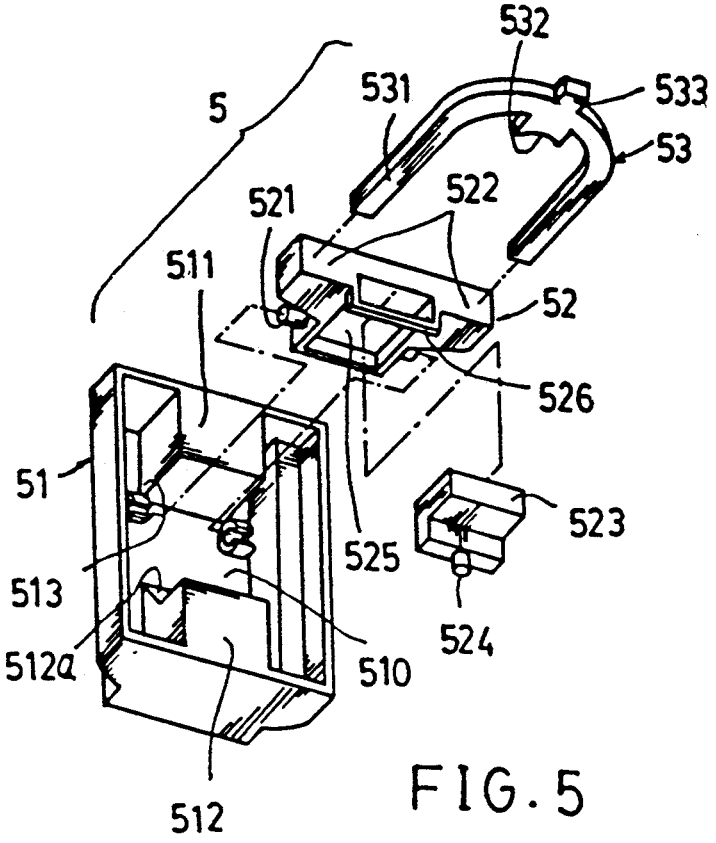
FIG. 5 is an exploded view showing the elements in construction of the control means of the present invention.

The protrusion engaging hole 132 formed in the main tube 13 on the first side A of the shaft means 1 has the lower slot end 132*a* separated from the lower protrusion 561 of the lower retainer 56 with a distance D when the umbrella is opened by engaging the lower protrusion 561 with the protrusion engaging hole 132 as shown in FIGS. 3, 4, allowing a downward movement of the lower protrusion 561, the core tube 54, the drag rod 57, the lower runner 24 and the rib means 2 for decreasing a wind-catching area to be a small area "a" smaller than a large area A of a conventional umbrella as mentioned in the first page of this specification.

Therefore the wind force W acting upon the umbrella cloth and the fractions W1, W2 acting on the rib 23, the lower runner 24 will lower the rod 57, and the lower protrusion 561 to the lower slot end 132*a* to decrease a wind-catching area to be "a", so that the total wind force, W=Wind pressure x area=Pw×a, will be smaller than the wind force, Wc=Pw×A of the conventional umbrella as aforementioned. The present invention can thereby be carried with a lighter force and can be held more conveniently.

The drag rod 57 has a lower rod end 571 secured with an upper end portion 543 of the core tube 54 and an upper rod end 572 protruding outwardly to be slidably engageable with an elongate rod slot 136 formed in an upper portion 135 of the main tube 13 to be secured with the lower runner 24. The lower rod end 571 of the drag rod 57 passes through a central hole 112*a* formed in a tube plug 112 formed in an upper end of the inner tube 11 for connecting an upper end portion 543 of the core tube 54 with the tube plug 112 retarding the upper end portion 543 of the core tube 54 when upwardly pulling the rod 57, the ribs 2 and the umbrella by an upwardly blowing wind W3 as shown in FIG. 3 to thereby stabilize the opened umbrella.

The lower runner 24 includes a cylindrical extension 241 for shielding the elongate rod slot 136 when opening the umbrella.

When using the present invention, the grip 12 can be depressed to compress and re-set the elastic energy of the umbrella-closing spring 4 from FIG. 1 to FIG. 2 and the main tube 13 can be lowered relatively until the wedge portion 532 of the sliding latch 53 engages the engaging hole 133 of the main tube 13 as shown in FIG. 2 so that a lower portion 131 of the main tube 13 is inserted into the central hole 121 of the grip 12 for compressing the spring 4 for storing its elastic energy. Meanwhile, the inner tube 11 is raised relatively to raise the plug 112 and button 51 so as to bias the biasing plate 52 downwardly inclinedly as shown in FIG. 2 by the upper protrusion 551 of the upper retainer 55. As shown in FIG. 2, the spring 4 has been re-set for storing its spring energy and the upper button surface 511 of the button 51 contacts the upper protrusion 551 of the upper retainer 55.

When opening the umbrella, the push button 51 is depressed inwardly to disengage the upper protrusion 551 from the hole 132 of the main tube 13 to uncouple the core tube 54 from the main tube 13, and the compressed umbrella-opening umbrella 3 will be released to urge the top sleeve 14 upwardly to pull the upper notch 21, and top rib 21 upwardly for opening the umbrella. The structure rib 23 and the connected lower runner 24 will pull the rod 57, and core tube 54 upwardly until the upper end portion 543 of the core tube 54 is retarded by the plug 112 of the inner tube 11 as shown in FIG. 3 and the lower protrusion 561 of the lower retainer 56 engages the protrusion hole 132, thereby stabilizing the opened umbrella as shown in FIG. 3.

When closing the umbrella from FIG. 3 to FIG. 1, the button 51 is depressed to retract the bifurcate arm members 531 to disengage the wedge portion 532 from the engaging hole 133 of the main tube 13 so that the umbrella-closing spring 4 will be released to eject the main tube 13 upwardly to fold the ribs 2 to close the umbrella and also compress the umbrella-opening spring 3 for re-setting its spring energy. The upper protrusion 551 is engaged with the protrusion hole 132 of the main tube 13 for coupling the core tube 54 with the main tube 13. It is noted that when depressing the button 51 as shown in FIG. 3 for closing the umbrella, the biasing plate 52 will be normally biased horizontally by the restoring spring 527 to allow the depression surfaces 522 to contact the bifurcate arm members 531, ready for an immediate retraction of the sliding latch 53 for uncoupling the main tube 13 from the inner tube 11 for opening the umbrella.

The present invention is superior to a conventional automatic umbrella with the following advantages:

1. When opening the umbrella, the present invention may automatically "shrink" its umbrella-cloth area for reducing the wind force, beneficial for a user's carrying.
2. The automatic opening and closing mechanism is quite simple for an easy production, minor maintenance problem, lower cost and high industrial value.
3. A reliable operation for opening or closing the umbrella can be enhanced for preventing an unexpected false operation.

I claim:

1. An automatic umbrella comprising:

a central shaft means including: an inner tube having a grip secured on a lower portion of the inner tube, a main tube slidably disposed around the inner tube, and a top sleeve slidably held on an upper end portion of the main tube;

an umbrella rib means secured with an umbrella cloth thereon including: a top rib having its inner rib end pivotally secured with an upper notch secured on a lower portion of the top sleeve, a stretcher rib having an inner rib end of the stretcher rib pivotally secured to a lower runner which is slidably held on the main tube, an intermediate rib pivotally secured to a middle notch which is secured on an upper end portion of the main tube adjacent to a lower end portion of the top sleeve with a middle rib portion of the intermediate rib pivotally secured to an outer rib end of the stretcher rib;

an umbrella-opening spring resiliently retained between the top sleeve and the upper end portion of the main tube for operatively opening the umbrella; an umbrella-closing spring resiliently retained between the inner tube and the main tube for operatively closing the umbrella; and a control means including: a push button slidably held in a button hole formed in the grip at a first side of the shaft means, a biasing plate pivotally mounted in the push button, a sliding latch laterally slidably held in the grip adjacent to a second side of the shaft means opposite to the first side of the shaft means for operatively engaging the main tube for retaining the umbrella-closing spring which has been compressed for storing an elastic energy of the umbrella-closing spring, a core tube slidably held in the inner tube having an upper resilient engaging retainer formed in an upper portion of the core tube for operatively engaging the main tube at a closing state of the umbrella and having a lower resilient engaging retainer formed in a lower portion of the core tube for operatively engaging the main tube at an opening state of the umbrella, and a drag rod connected between the core tube and the lower runner, whereby upon a depression of the push button when the umbrella is closed to disengage the upper resilient engaging retainer from the main tube, the umbrella-opening spring will urge the rib means and the umbrella cloth for opening the umbrella; and upon a depression of the push button when the umbrella is opened to disengage the main tube from the inner tube, the umbrella-closing spring will eject the main tube for folding the rib means for closing the umbrella.

2. An automatic umbrella according to claim 1, wherein said push button includes: an upper button surface formed on an upper inside portion of the button operatively contacting an upper protrusion of the upper engaging retainer, a lower button surface formed on a lower inside portion of the button operatively contacting a lower protrusion of the lower engaging retainer, an inner cavity recessed in an inner portion of the button between the upper and lower button surfaces for pivotally mounting the biasing plate in the cavity, a pair of brackets for pivotally engaging two pivots of the biasing plate, and an inclined-surface portion formed in a lower portion of the cavity for retaining a restoring spring of the biasing plate for normally urging the biasing plate to be horizontally positioned.

3. An automatic umbrella according to claim 2, wherein said biasing plate is generally triangular shaped and enlarged inwardly towards a center of the central shaft means to form two depression surfaces contacting two bifurcate arm members of the sliding latch, and includes: a sliding plate slidably held in a groove recessed in the biasing plate and retained by a limiting bracket formed under the biasing plate, a stem protruding inclinedly downwardly from the sliding plate for retaining the restoring spring retained in the push button, and the restoring spring, normally urging the sliding plate horizontally for contacting the two bifurcate arm members of the sliding latch, and urging the sliding plate inwardly to be protruded beyond the depression surfaces of the biasing plate to be operatively pressed or bent downwardly by the upper retainer when compressing the spring for preventing an unexpected false depression of the sliding latch for disengaging the main tube from the inner tube for falsely releasing the elastic energy of the umbrella-closing spring when opening the umbrella.

4. An automatic umbrella according to claim 3, wherein said sliding latch includes: the two bifurcate arm members laterally slidably disposed about the main tube, a latch rod formed on a converging end of the two arm members jacketed by a tensioning spring retained in a spring hole formed in a second side of the shaft means for normally urging the two bifurcate arm members laterally to be contacted by the biasing plate, a wedge portion secured on the latch rod between the two arm members for engaging an engaging hole formed in the main tube at the second side of the shaft means for coupling the main tube with the inner tube having the umbrella-closing spring under compression retained in between the main and the inner tubes.

5. An automatic umbrella according to claim 1, wherein said core tube slidably held in the inner tube includes the upper retainer having the upper protrusion and the lower retainer having the lower protrusion slidably engageable with an elongate slot formed in the inner tube at the first side of the shaft means having a lower slot end of the elongate slot approximating a lower end portion of the inner tube and having an upper slot end of the elongate slot adjacent to an upper end portion of the core tube, with the upper protrusion operatively engaging a protrusion engaging hole formed in the main tube at the first side of the shaft means for closing the umbrella and with the lower protrusion operatively engaging the protrusion hole in the main tube for opening the umbrella.

6. An automatic umbrella according to claim 5, wherein said protrusion engaging hole formed in the main tube on the first side of the shaft means has the lower slot end separated from the lower protrusion of the lower retainer with a distance when the umbrella is opened by engaging the lower protrusion with the protrusion engaging hole, allowing a downwardly movement of the lower protrusion, the core tube, the drag rod, the lower runner and the rib means for decreasing a wind-catching area to be a small area for resisting a strong wind force when opening the umbrella.

7. An automatic umbrella according to claim 5, wherein said drag rod has a lower rod end secured with an upper end portion of the core tube and an upper rod end protruding outwardly to be slidably engageable with an elongate rod slot formed in an upper portion of the main tube to be secured with the lower runner, the lower rod end of the drag rod passing through a central hole formed in a tube plug formed in an upper end of the inner tube for connecting an upper end portion of the core tube with the tube plug retarding the upper end portion of the core tube when upwardly pulling the rod, the rib means and the umbrella by an upwardly blowing wind to thereby stabilize the opened umbrella.

8. An automatic umbrella according to claim 7, wherein said lower runner includes a cylindrical extension for shielding the elongate rod slot of the main tube when opening the umbrella.

* * * * *